United States Patent [19]

Corson

[11] 4,179,778

[45] Dec. 25, 1979

[54] MEANS FOR MINIMIZING PROCESSING IMPLOSIONS IN CRT MANUFACTURE

[75] Inventor: Robert M. Corson, Ottawa, Ohio

[73] Assignee: GTE Sylvania Incorporated, Stamford, Conn.

[21] Appl. No.: 963,071

[22] Filed: Nov. 22, 1978

Related U.S. Application Data

[62] Division of Ser. No. 865,409, Dec. 29, 1977, Pat. No. 4,152,036.

[51] Int. Cl.[2] ..... H01J 9/24

[52] U.S. Cl. ..... 29/25.19; 316/30; 316/27

[58] Field of Search ..... 29/25.19, 25.2; 316/27, 316/30; 269/321 T

[56] References Cited

U.S. PATENT DOCUMENTS

| | | | |
|---|---|---|---|
| 3,118,662 | 1/1964 | Fassett et al. | 269/296 |
| 3,329,422 | 7/1967 | Hajduk | 269/287 |
| 3,787,937 | 1/1974 | Palac | 29/25.13 |
| 3,806,108 | 4/1974 | Adachi et al. | 29/25.19 X |

*Primary Examiner*—Richard B. Lazarus
*Attorney, Agent, or Firm*—William H. McNeill

[57] ABSTRACT

Heat activated means are provided for applying areas of external pressure to the periphery of the panel portion of a cathode ray tube envelope during heat processing. The pressure is directly related to the heat cycle to which the tube envelope is subjected, and induces a state of compression in particularly the panel portion thereby minimizing the occurrence of implosions.

7 Claims, 6 Drawing Figures

Fig. 3
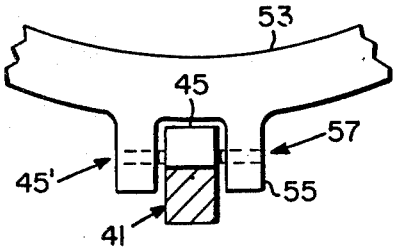
Fig. 4
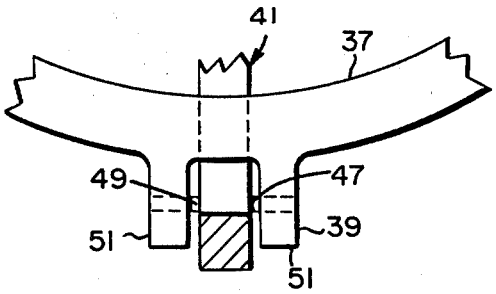
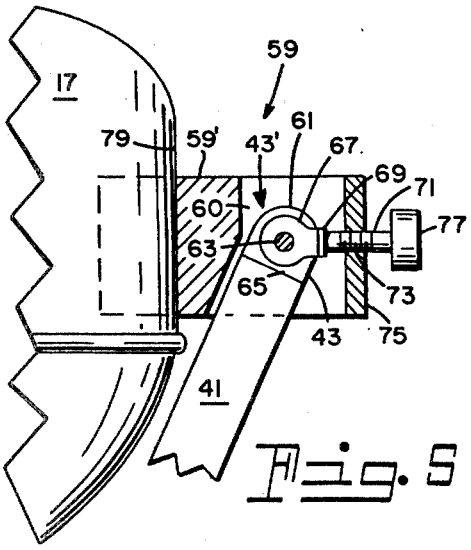
Fig. 5
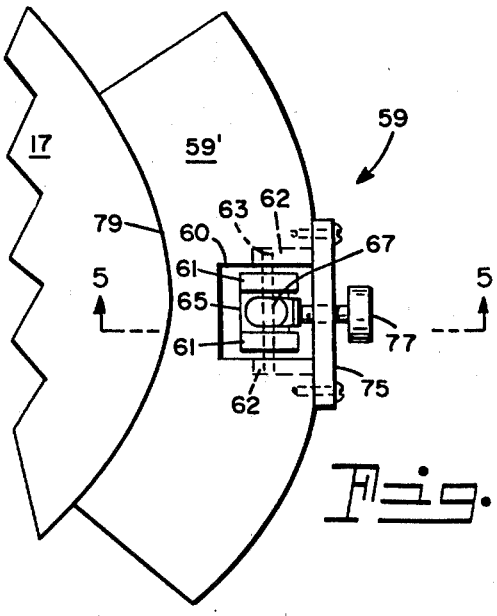
Fig. 6

MEANS FOR MINIMIZING PROCESSING IMPLOSIONS IN CRT MANUFACTURE

CROSS-REFERENCE TO RELATED APPLICATION

This application is a divisional of Ser. No. 865,409, filed Dec. 29, 1977 now U.S. Pat. No. 4,152,036 and assigned to the assignee of the present invention.

BACKGROUND OF THE INVENTION

This invention relates to cathode ray tubes and more particularly to a means and method for processing the same to minimize processing incurred implosions.

Cathode ray tubes, such as those employed in both monochrome and color television and allied applications, are commonly fabricated with all-glass envelopes formed of an integration of viewing panel, funnel and neck portions.

During envelope fabrication and subsequent storage, handling and tube manufacturing, the surfaces of the envelope are vulnerable to accidental abrasion and scratching even though rigid quality procedures and controls are implemented. It has been found that the surface tensions produced in the glass envelope during particularly the tube exhaust procedure may become critical factors during the cooling portion of the process due to atmospheric pressure and temperature differences existent between the inner and outer surfaces of the envelope. Therefore, tubes having surface defects, in particularly the panel area, are apt to implode during tube exhaust processing because of these expansive and contractive forces induced in the glass during the heat cycle. In view of the possibility of the interaction of aggravative factors at abraded surface areas, attempts have been made to minimize the risk of implosions of such tubes by lengthening the critical cooling segment of the exhaust process. Thus, the excessive time required to provide an economically acceptable implosion level by slower cooling becomes a limiting factor in the rate of tube production and an additional manufacturing cost consideration. Despite efforts to minimize surface defects and the following of a lengthened exhaust cooling schedule, occassional implosions still occur during processing.

Economic losses incurred by tubes scrapped because of surface defects, implosions during processing, and increased costs incurred by slow or reduced rate of production are important factors consituting a perplexing problem encountered in cathode ray tube manufacturing.

OBJECTS AND SUMMARY OF THE INVENTION

Accordingly, it is an object of the invention to reduce and obviate the aforementioned disadvantages that have been evidenced in the prior art.

It is another object of the invention to improve tube manufacturing.

It is a further object of the invention to provide a means and a method for improving exhaust processing of a cathode ray tube.

These and other objects and advantages are achieved in one aspect of the invention by the provision of a method for applying areas of external pressure to the periphery of the panel portion of a cathode ray tube envelope during heat processing to keep the panel in compression. By applying this compressive force, implosions are reduced.

To accomplish this method the tube is placed in a device having a plurality of pressure heads shaped to fit the peripheral contour of the panel. These heads are attached to the upper ends of pivoted lever arms while the lower ends of the arms are affixed to a ring-like heat-expansive member. The temperatures encountered during the heat cycle of the procedure causes the heat-expansive member to expand thereby imparting movement to the lever arms which, in turn, causes the pressure heads to exert a compressive force against discrete peripheral areas of the panel. The resultant compression produced within the panel is gradually reduced by contraction of the expansive member during the critical cooling portion of the heat cycle of the process. This controlled state of compression tends to counteract the tension forces normally set up within the glass structure of the panel. Thus, any abraded surface areas thereof are not subjected to internal force differentials of a degree to cause implosion of the tube.

BRIEF DESCRIPTION OF THE DRAWINGS

FIG. 3 is an enlarged partial illustration taken along the line 3—3 of FIG. 1 showing one of the movable jointure supports incorporated within the device of the invention;

FIG. 4 is an enlarged partial view taken along the line 4—4 of FIG. 1 showing one of the pivot means utilized in the invention;

FIG. 5 is an enlarged sectional view illustrating the juncture of a lever arm with a pressure head taken along the line 5—5 of FIGS. 2 and 6; and FIG. 6 is an enlarged plan view of a pressure head taken along the line 6—6 of FIG. 1.

DESCRIPTION OF THE PREFERRED EMBODIMENTS

For a better understanding of the present invention, together with other and further objects, advantages and capabilities thereof, reference is made to the following specification and appended claims in conjunction with the aforedescribed drawings.

Figure 1:
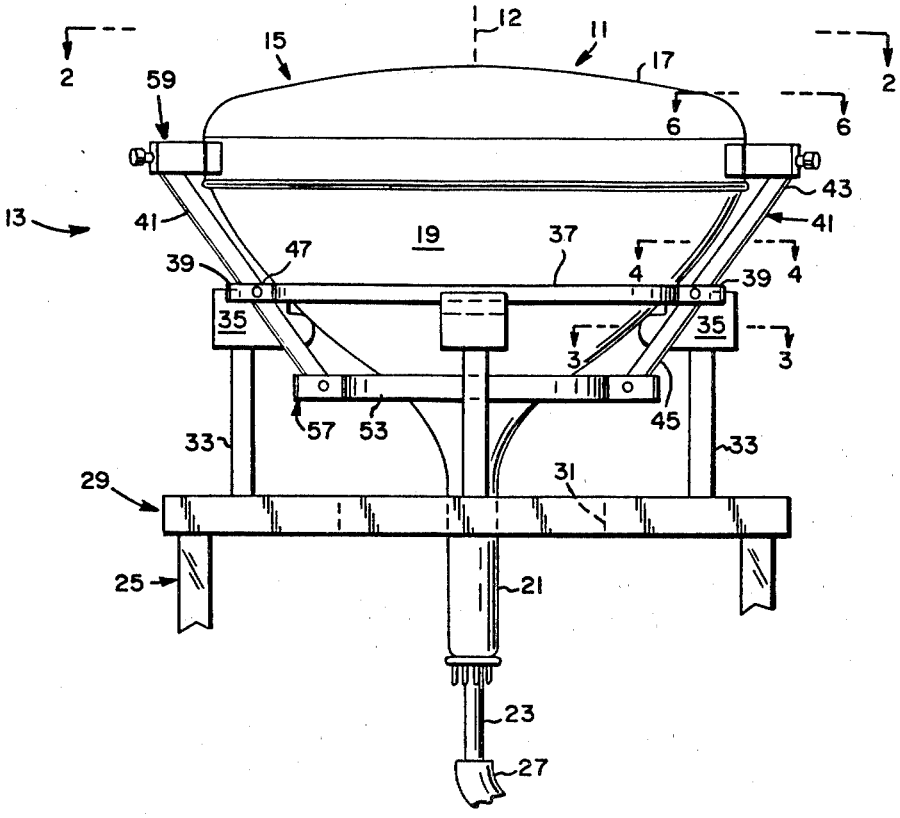
FIG. 1 is an elevational view showing a cathode ray tube oriented within the device of the invention.
Figure 2:
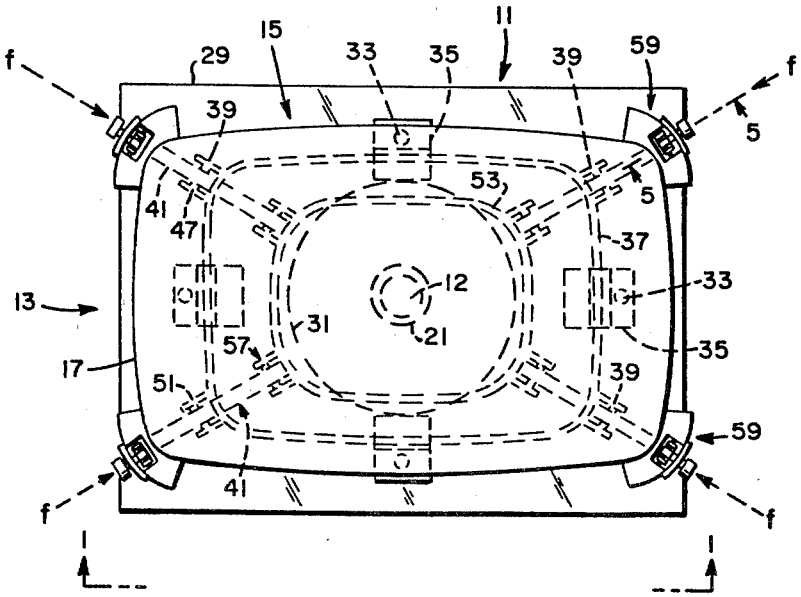
FIG. 2 is a plan view of the tube and device taken along the line 2—2 of FIG. 1.

With reference to the drawings, there is shown in FIGS. 1 and 2, a cathode ray tube 11 oriented in the pressure application device 13 of the invention. The tube is either a monochrome or plural color type of which the internal structure is not delineated as such is immaterial to the invention. The encompassing envelope 15 of the tube, which has a longitudinal axis 12 therethough, is formed as an integration of viewing panel 17, funnel 19 and neck 21 portions with an exhaust tubulation 23 projecting outwardly therefrom. The internal structures of the tube, while not shown, are basically comprised of a cathodoluminescent screen disposed on the interior surface of the panel 17 and an electron gun structure positioned within the neck portion 21 in a manner to direct one or more controlled electron beams to impinge the screen and create an image display thereon.

The device of the invention 13 is a means for applying substantially radially directed pressure "f" to discrete peripheral areas of the panel portion 17 in a manner substantially normal to the longitudinal axis 12 of the envelope 15. While the concept of the device 13 may be used in several areas of the tube fabrication procedure wherein ambient heat is applied to the envelope, it is described and delineated in this instance, as being particularly beneficial in the tube exhaust process.

As shown in FIG. 1, the device 13 is associated with the super structure 25 of an exhaust cart, the details of which are not shown. Such a cart, being a conventional unit of which many are employed in tube manufacturing, is usually constructed to accommodate an individual tube. Each exhaust cart normally includes vacuum pumping means along with localized heating and electronic equipment associated with tube processing.

During the tube exhausting procedure, the exhaust tubulation 23 is attached to a tubing 27 which is connected to the vacuum or gas evacuation system associated with the cart. A number of carts are then moved sequentially past an oven arrangement on the exhaust machine, wherein the envelope is subjected to external heat to substantially degas the envelope and the structures included therein. During this outgassing procedure, the temperature of particularly the panel 17 and funnel 19 portions of the envelope, is gradually increased to a substantially constant level in the order of 390°–400° C. in accordance with a predetermined heating profile. The internal ambient and released occluded gases within the tube are evacuated through the vacuum system by extended pumping during the following of the temperature profile. It is conventional to supply extra heat to the region of the electron gun structure by induction heating means substantially localized relative to the neck 21 portion of the envelope.

After a predetermined length of time, during which degassing and evacuation have been in progress, the ambient temperature surrounding the tube is gradually decreased. As aforenoted, it is during this cooling sequence of the exhaust heat cycle that those tubes having glass surface abrasions, are apt to implode. It is the purpose of this invention to minimize such implosions.

The pressure application means of the invention, which in this instance is associated with an exhaust cart, is supported on the super structure 25 thereof by a base plate 29, having a large central opening 31 therein of a size sufficient to amply accommodate the neck portion 21 of the tube and any auxiliary electrical processing equipment which may be associated therewith during the fabrication procedure.

Affixed to the base plate 29, and extending upward therefrom, are a plurality of spaced apart risers 33, weach having a terminal head 35 fashioned to provide support seating for the funnel portion 19 of the tube envelope. These several support heads or means, being formed to provide minimal non-abrasive contact with the funnel, are collectively in a plane substantially normal to the axis 12.

Also oriented to rest upon these support heads 35 is a first closed ring-like member 37 fabricated of a material exhibiting a low coefficient of linear thermal expansion at temperature below 500° C.

Such materials may be alloys such as Invar, or laminated fabrications constituted to produce minimal expansion upon heating. This first closed member has a perimetric dimension greater than that of the funnel portion at the region of support, and located around the periphery thereof are a plurality of spatially related pivot means 39.

Associated with the pivot means of the first member 37 are a plurality of lever arms 41 formed of a rigid material exhibiting a low coefficient of linear thermal expansion at temperatures below 500° C. Such materials may be those previously mentioned as suitable for fabrication of the first closed member 37. Each of the arms has an upper end 43 and a lower end 45, with respective terminal attachment elements 43' and 45' thereat and a pivot point 47 therebetween. Each of these individual arms is related in a similar angular manner with the first closed member 37, whereby the intermediate pivot point 47 of the arm is associated with a respective pivot means 39 of the first member. Such pivoted association may be, for example, a pin 49 traversing the arm 41 and mating with apertured ears 51 extending from the periphery of the first member 37 as shown in FIG. 4.

A second closed ring-like member 53 is fabricated of a material, such as a steel alloy, exhibiting a high coefficient of linear thermal expansion at temperatures above 20° C. This second member is formed to have a perimetric dimension smaller than that of the first closed member 37, and has a plurality of spaced apart attachment means 55 formed peripherally thereon in a manner to effect movable jointure affixation with the lower attachment elements 45' of the respective arms 41. This movable jointure is accomplished, for example, by a pin-and-ears arrangement 57, such as illustrated in FIG. 3.

A plurality of spaced-apart contact heads 59 are each movably affixed to the upper attachment elements 43' of the respective lever arms 41. These contact heads are fabricated of a material exhibiting a minimal coefficient of linear thermal expansion at temperatures below 500° C. The movable association of these heads with the respective arms is effected in a manner to permit individual lateral adjustment of each head in a plane substantially normal to the axis 12.

The adjustable relationship of the contact head and lever arm jointure is accomplished, for example, by the arrangement detailed in FIGS. 5 and 6. As shown, the upper end 43 of each lever arm is slotted to provide two terminal ears 61 which are apertured to accept a pin 63 therethrough. The head member 59' has an open recess 60 formed therein, wherein the slotted end of the arm is positioned. Two side-related channels 62 are formed in the walls of the recess 60 to enable adjustable sliding movement of the ends of pin 63 therealong. The width of the terminal slot 65 is such as to accommodate an eye 67, which rides on the pin 63, and is swivelly attached at 69 to a threaded shaft 71 traversing a threaded aperture 73 in plate 75. A knob 77 is affixed to the exterior end of the shaft 71 to facilitate individual lateral adjustment of each head member 59' relative to the end of arm 41. Each head 59 has a face portion 79 oriented toward the axis 12 and formed to have a contour shaped to fit an area of the periphery of the panel portion 17 of the tube envelope.

The operation of the pressure application device 13 is described in an exemplary exhaust processing situation, wherein the tube, being connected to a vacuum pumping system, is subjected to the gradual application of ambient heat. This processing temperature effects a heat cycle having a profile of increasing, substantially constant and decreasing portions to expedite degassing of the tube envelope and the components encompassed therein. As the temperature increases, the second closed member 53 of the device expands. Since the first closed member 37 is relatively stable, its pivot means 39 provide fulcrums for the lever arms 41. Thus, as the temperature of the device increases in accordance with the profile, the contact heads 59 are moved substantially radially inward to gradually apply external compressive pressure "f" to spaced apart areas of the panel periphery, thereby effecting a desired state of compression in the panel. Since the degree of external peripheral pressure applied to the panel is directly related to the temperature or heat cycle profile, the pressure gradually lessens during the decreasing portion of the cycle thereby gradually reducing the induced state of compression in the panel.

Inasmuch as the respective contact heads 59 are individually adjustable, the pressures "f" can be equalized. This is accomplished in an off-the-line semi-laboratory procedure, wherein the stress patterns developed in the panel of a test envelope in the heated device are visually studied with a polariscope to determine the desired pressure adjustments of the contact heads.

While the foregoing delineation concerns an exemplary tube envelope having a substantially rectangular face panel whereof the external pressures are applied to substantially the corner regions thereof, the concept of the invention is not limited thereto, as the principles apply equally to tubes having panels of other shapes. In such instances, possibly three or more than four pressure areas may be utilized by making obvious modifications of the device.

Thus, there is provided a means for providing an improvement in cathode ray tube manufacturing.

While there has been shown and described what are at present considered the preferred embodiments of the invention, it will be obvious to those skilled in the art that various changes and modifications may be made therein without departing from the scope of the invention as defined by the appended claims.

What is claimed is:

1. Means for applying external pressure to discrete peripheral areas of the panel portion of a cathode ray tube envelope in a manner substantially normal to the longitudinal axis thereof during ambient heat processing, said envelope being formed as an integration of panel, funnel and neck portions, said pressure application means being a device formed to spatially encompass portions of said tube envelope comprising: a plurality of spaced-apart support means fashioned to provide support seating for the funnel portion of said tube envelope, said support means being in a plane substantially normal to said axis; a first closed ring-like member fabricated of a material exhibiting a low coefficient of linear thermal expansion and oriented to rest upon said support means, said first member having a perimetric dimension greater than that of said funnel portion at the region of support, said first member having a plurality of spaced-apart pivot means located on the periphery thereof; a plurality of lever arms formed of low-expansive material and related in an angular manner with said first member, each of said arms having an upper and lower end with a respective attachment element thereat and a pivot point therebetween, each of said pivot points being associated with a respective pivot means on said first member; a second closed ring-like member fabricated of a material exhibiting a high coefficient of linear thermal expansion and formed to have a perimetric dimension smaller than that of said first member, said second member having a plurality of spaced apart attachment means peripherally formed thereon to effect movable jointure affixation with the lower attachment elements of the respective lever arms; and a plurality of spaced-apart contact heads each being movably affixed to the upper attachment elements of the respective lever arms, each of said heads having a face portion oriented toward said axis and being formed with a contour shaped to fit a portion of the periphery of said panel.

2. The means for applying external pressure to the panel portion of a cathode ray tube envelope according to claim 1 wherein said device is acomprised of four lever arms and four contact heads.

3. The means for applying external pressure to the panel portion of a cathode ray tube envelope according to claim 1 wherein each contact head is affixed to the upper attachment element of the respective lever arm in a manner to permit lateral adjustment of each head in a plane substantially normal to said envelope axis.

4. The means for applying external pressure to the panel portion of a cathode ray tube envelope according to claim 1 wherein said fist ring-like member is fabricated of a material exhibiting a minimal coefficient of linear thermal expansion at temperatures below 500° C.

5. The means for applying external pressure to the panel portion of a cathode ray tube envelope according to claim 1 wherein said second ring-like member is fabricated of a material exhibiting a high coefficient of linear thermal expansion at temperatures above 20° C.

6. The means for applying external pressure to the panel portion of a cathode ray tube envelope according to claim 1 wherein said lever arms are formed of a rigid material exhibiting a minimal coefficient of linear thermal expansion at temperatures below 500° C.

7. The means for applying external pressure to the panel portion of a cathode ray tube envelope according to claim 1 wherein said contact heads are fabricated of a material exhibiting a minimal coefficient of linear thermal expansion at temperatures below 500° C.

* * * * *